US006846402B2

(12) United States Patent
Hemighaus et al.

(10) Patent No.: US 6,846,402 B2
(45) Date of Patent: Jan. 25, 2005

(54) THERMALLY STABLE JET PREPARED FROM HIGHLY PARAFFINIC DISTILLATE FUEL COMPONENT AND CONVENTIONAL DISTILLATE FUEL COMPONENT

(75) Inventors: Gregory Hemighaus, Richmond, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 88 days.

(21) Appl. No.: 10/000,586

(22) Filed: Oct. 19, 2001

(65) Prior Publication Data

US 2003/0116469 A1 Jun. 26, 2003

(51) Int. Cl.[7] ..... C10L 1/04

(52) U.S. Cl. ..... 208/14; 208/15; 585/6; 585/16; 585/1

(58) Field of Search ..... 208/14, 15; 585/1, 585/6, 16

(56) References Cited

U.S. PATENT DOCUMENTS

| | | | |
|---|---|---|---|
| 3,149,933 | A | 9/1964 | Ley et al. |
| 3,219,666 | A | 11/1965 | Norman et al. |
| 3,438,757 | A | 4/1969 | Honnen et al. |
| 3,533,938 | A | 10/1970 | Leas |
| 3,883,418 | A | 5/1975 | Drehman et al. |
| 3,985,638 | A | 10/1976 | Kirk, Jr. |
| 4,160,648 | A | 7/1979 | Lewis et al. |
| 4,320,020 | A | 3/1982 | Lange |
| 4,320,021 | A | 3/1982 | Lange |
| 4,330,302 | A | 5/1982 | Taylor |
| 4,347,148 | A | 8/1982 | Davis |
| 4,386,939 | A | 6/1983 | Lange |
| 5,621,154 | A | 4/1997 | Wright et al. |
| 5,766,274 | A | 6/1998 | Wittenbrink et al. |
| 5,830,244 | A | 11/1998 | Cherpeck |
| 5,849,048 | A | 12/1998 | Cherpeck |
| 5,851,242 | A | 12/1998 | Cherpeck et al. |
| 5,853,436 | A | 12/1998 | Cherpeck |
| 5,865,861 | A | 2/1999 | Cherpeck |
| 5,916,825 | A | 6/1999 | Cherpeck |
| 5,954,843 | A | 9/1999 | Cherpeck |
| 5,993,497 | A | 11/1999 | Cherpeck et al. |
| 6,033,446 | A | 3/2000 | Cherpeck et al. |
| 6,114,542 | A | 9/2000 | Cherpeck |

FOREIGN PATENT DOCUMENTS

| | | |
|---|---|---|
| EP | 0321305 B1 | 5/1992 |
| GB | 767658 | 2/1957 |
| WO | WO00/11116 | 3/2000 |
| WO | WO00/11117 | 3/2000 |
| WO | 01/59034 A2 | 8/2001 |

OTHER PUBLICATIONS

ASTM D3241, *Standard Test Method for Thermal Oxidation Stability of Aviation Turbine Fuels*, Sep. 1, 2000, pp. 1–12, American Society for Testing and Materials, West Conshohocken, PA.

Bacha, J.D., et al., *Diesel Fuel Stability and Instability: A Simple Conceptual Model, IASH 2000, the 7th International Conference on Stability and Handling of Liquid Fuels*, Graz, Austria, Sep. 24–29, 2000, pp. 1–7.

*Gasoline and Diesel Fuel Additives, Critical Reports on Applied Chemistry*, vol. 25, 1989, pp. 4–27, Published for Society of Chemical Industry by John Wiley & Sons, New York.

Vardi, et al., *Peroxide Formation in Low Sulfur Automotive Diesel Fuels920826, SAE Technical Paper Series: The Engineering Society for Advancing Mobility Land Sea Air and Space Interanational*, International Congress & Exposition Detroit, MI, Feb. 24–28, 1992, Society of Automotive Engineers, Inc.

International Search Report.

UK Search Report dated Apr. 29, 2003.

Netherlands Search Report dated Jun. 24, 2003.

*Primary Examiner*—Walter D. Griffin
*Assistant Examiner*—Tam Nguyen
(74) *Attorney, Agent, or Firm*—Burns, Doane, Swecker & Mathis, L.L.P.

(57) ABSTRACT

A stable distillate fuel blend useful as a fuel or as a blending component of a fuel that is suitable for use in turbine engine, said fuel blend prepared from at least one highly paraffinic distillate fuel component having low to moderate branching and at least one conventional petroleum-derived distillate fuel component and a process for preparing same involving the blending of at least two components having antagonistic properties with respect to one another.

23 Claims, No Drawings

THERMALLY STABLE JET PREPARED FROM HIGHLY PARAFFINIC DISTILLATE FUEL COMPONENT AND CONVENTIONAL DISTILLATE FUEL COMPONENT

FIELD OF THE INVENTION

The present invention is directed to a thermally stable jet fuel blend comprising a highly paraffinic distillate fuel component having low to moderate branching, such as a product derived from the low temperature Fischer Tropsch process, and a petroleum-derived distillate fuel component and to a process for making a stable blend when the components are antagonistic with respect to the other.

BACKGROUND OF THE INVENTION

Distillate fuels which are intended for use in jet turbines must meet certain minimum standards in order to be suitable for use. Jet fuel must have good oxidation stability in order to prevent the formation of unacceptable amounts of deposits which are harmful to the turbine engines in which they are intended to be used. Jet fuel is also used as a heat sink in turbine engines. These deposits will create maintenance problems in the turbine engines. Currently, fuel thermal stability is recognized as one of the most important properties of jet fuels. ASTM D3241 is the standard analytical procedure for rating fuel thermal stability and a fuel will either pass or fail at a given temperature. Preferred fuels for use in jet turbines will usually have a passing jet fuel thermal-oxidation tester (JFTOT) rating as measured by ASTM D3241 at 260° C.

Distillates having very high levels of saturates, such as distillates recovered from the Fischer Tropsch process, have been shown to have excellent smoke points, usually in excess of 40 mm, and low sulfur contents. As such, highly paraffinic distillates appear to be useful for blending with lower quality distillates in order to obtain a distillate blend meeting the requirements for jet fuel. What has not been recognized is that some highly paraffinic distillate components, especially those characterized by low to moderate branching of the molecule, such as those products produced by the low temperature Fischer Tropsch process, when blended with conventional distillate components can show poor thermal stability leading to the formation of unacceptable amounts of deposits.

In general, two classes of oxidation stability are of concern in this disclosure. The first is the result of low sulfur levels in the distillate, such as are found in Fischer Tropsch distillates and in fuels which have been hydrotreated to low sulfur levels. Such hydrocarbons are known to form peroxides which are undesirable because they tend to attack the fuel system elastomers, such as are found in O-rings, hoses, etc. The second source of concern is in the decline in thermal-oxidation stability as a result of the blending of the different components. For example, it has been found that highly paraffinic distillates, such as Fischer Tropsch products produced using the low temperature process, when blended with petroleum-derived distillates may result in an unstable blend which has unacceptable thermal-oxidation stability. When a blend of at least two distillate fuel components in some blending proportions result in a decline in the thermal-oxidation stability as measured by ASTM D3241, the components are described as having "antagonistic properties".

In the case of peroxide formation, it has been suggested that the formation of peroxides in the blends may be controlled by increasing the sulfur content of the blend. See WO 00/11116 and WO 00/11117 which describe the addition of at least 1 ppm sulfur to the blend in order to prevent sulfur formation. This approach has two drawbacks. The first is that this approach does not address the problem associated with the antagonistic properties of the blending components. The second problem is that sulfur in fuels is considered an environmental hazard and it is generally desirable to reduce the level of sulfur in fuels not increase it.

The present invention is directed to a process for blending highly paraffinic distillate fuel components with low to moderate branching and conventional petroleum-derived distillate fuel components to prepare an acceptable jet fuel, wherein the two components have antagonistic properties at certain ratios which result in the a decline in the thermal-oxidation stability as measured by ASTM D3241. The invention also results in a unique product blend which is suitable for use in turbine engines.

BRIEF DESCRIPTION OF THE INVENTION

The present invention is directed to distillate fuel blend useful as a fuel or as a blending component of a fuel suitable for use in a turbine engine, said distillate fuel blend comprising (a) at least one highly paraffinic distillate fuel component having a paraffin content of not less than 70 percent by weight and a branching index within the range of from about 0.5 to about 3; and (b) at least one petroleum-derived distillate fuel component, wherein the distillate fuel blend has an ASTM D3241 breakpoint equal to or greater than 260° C. Highly paraffinic distillate fuel components are preferred which have paraffin contents of at least 80 percent by weight, with paraffin contents of more than 90 percent by weight being particularly preferred. Highly paraffinic distillate fuel components suitable for use in carrying out the present invention may be obtained from the oligomerization and hydrogenation of olefins, the hydrocracking of paraffins, or from the Fischer Tropsch process. The present invention is particularly advantageous when the distillates are recovered from the low temperature Fischer Tropsch process. The petroleum-derived distillate fuel component may be obtained from refining operations such as, for example, hydrocracking, hydrotreating, fluidized bed catalytic cracking (FCC and the related TCC process), coking, pyroysis operations, MEROX® process, MINALK® process and the like. The petroleum-derived distillate fuel component will preferably have an ASTM D3241 breakpoint of at least 275° C., preferably at least 290° C., and most preferably at least 300° C.

The distillate fuel blend composition described herein is suitable for use as a fuel in a turbine engine or it may be used as a distillate fuel blend component to prepare a fuel blend suitable for use in a turbine engine. As used in this disclosure the term "distillate fuel" refers to a fuel containing hydrocarbons having boiling points between approximately 60° F. and 1100° F. "Distillate" refers to fuels, blends, or components of blends generated from vaporized fractionation overhead streams. In general distillate fuels include naphtha, jet fuel, diesel fuel, kerosene, aviation gas, fuel oil, and blends thereof. A "distillate fuel blend component" in this disclosure refers to a composition which may be used with other components to form a distillate fuel meeting at least one of the specifications for jet fuel, most particularly salable jet fuel.

As used in this disclosure the term "salable jet fuel" refers to a material suitable for use in turbine engines for aircraft or other uses meeting the current version of at least one of the following specifications:

ASTM D1655.

DEF STAN 91—91 (DERD 2494), TURBINE FUEL, AVIATION, KEROSINE TYPE, JET A-1, NATO CODE: F-35.

International Air Transportation Association (IATA) "Guidance Material for Aviation Turbine Fuels Specifications".

United States Military Jet fuel specifications MIL-DTL-5624 (for JP-4 and JP-5) and MIL-DTL-83133 (for JP-8).

The present invention is also directed to a process for preparing a stable distillate fuel blend comprising at least two components having antagonistic properties with respect to one another, said distillate fuel blend being useful as a fuel or as a blending component of a fuel suitable for use in a turbine engine which comprises the steps of (a) blending at least one petroleum derived distillate fuel component with at least one highly paraffinic distillate fuel component having a paraffin content of not less than 70 percent by weight and a branching index within the range from about 0.5 to about 3; (b) determining the thermal stability of the blend of step (a) using a suitable standard analytical method; (c) modifying the blending of step (a) to achieve a pre-selected stability value as determined by the analytical method of step (b); and (d) recovering a distillate fuel blend that is characterized by having a breakpoint value of 260° C. or greater as determined by ASTM D3241. As will be explained in greater detail below the modification of blending step (a) as described in step (c) may be accomplished by several means. One particularly preferred means for adjusting the breakpoint of the blend is to select a petroleum-derived distillate component having a breakpoint of 275° C. or higher, preferably about 290° C. or higher, and most preferably about 300° C. or higher. Other preferred means include hydroprocessing the petroleum-derived distillate component and the use of additives. Other methods for modifying the blending step include adjusting the ratio of the highly paraffinic distillate fuel component to the petroleum-derived distillate fuel component; adjusting the boiling range of the highly paraffinic distillate fuel component; or adjusting the extent of isomerization of the highly paraffinic fuel component.

ASTM D3241 describes the test to measure distillate fuel thermal stability. The breakpoint of the fuel is defined as the highest temperature, x° C., at which the fuel receives a passing rating, and where a test at (x+5)° C. results in a failing rating. The minimum JFTOT breakpoint for salable jet fuel is 260° C. It should be obvious that fuels having even higher stability as measured ASTM D3241 would be desirable. Thus the preferred jet fuel will have a breakpoint of 270° C. with a breakpoint of 280° C. being even more preferred. While ASTM D3241 is the preferred test for adjusting the blending step in the process of the present invention, one skilled in the art will recognize that it may be possible to develop alternative tests which correlate directly with the results of ASTM D3241 when conducted according to the present invention. Therefore, the process of the invention should not be limited to only the use of ASTM D3241 in step (c) but also should include equivalent tests which produce the same or very similar results.

DETAILED DESCRIPTION OF THE INVENTION

The present invention is concerned with the preparation of a unique distillate jet fuel blend containing at least two distillate components having antagonistic properties relative to one another. The distillate fuel blend of the present invention will contain at least one highly paraffinic distillate fuel component having a branching index within the range from about 0.5 to about 3 and one petroleum derived distillate fuel component. Highly paraffinic distillate fuel components such as used in preparing the compositions of the present invention may be obtained from the oligomerization and hydrogenation of olefins or by the hydrocracking of paraffins, but are most readily available as the product of a Fischer Tropsch synthesis, especially the low temperature Fischer Tropsch process. The highly paraffinic distillate fuel component used to prepare the distillate fuel blends of the present invention will have a paraffin content of not less than 70 percent by weight, preferably not less than 80 percent by weight, and most preferably not less than 90 percent by weight.

The direct products of the low temperature Fischer Tropsch process usually are not suitable for use in distillate fuels due to the presence of olefins and oxygenates. Therefore, further treatment, such as by hydroprocessing, of the Fischer Tropsch products is usually desirable to remove these impurities prior to their use as the highly paraffinic distillate fuel component. Distillate fuels and fuel components prepared from the low temperature Fischer Tropsch process by upgrading processes that use hydroprocessing are almost 100 percent saturated, i.e., they are essentially 100 percent paraffinic, and typically have smoke points which are in excess of 40 mm. They also contain low levels of sulfur and other hetroatoms. Unfortunately the low levels of heteroatoms, in particular sulfur, make the Fischer Tropsch distillate fuel component susceptible to the formation of peroxides. However, most conventional petroleum-derived distillates used to blend with the Fischer Tropsch products will contain in excess of 1 ppm sulfur and will help to stabilize the blend. Since Fischer Tropsch derived fuel components have excellent smoke points, they are often viewed as an ideal component for blending with lower quality conventional distillate fuel components. What has not been generally recognized is that blends of Fischer Tropsch derived fuel components when blended with conventional components may be unstable and form unacceptable amounts of deposits. The low to moderate branching in the molecules makes blends of the Fischer Tropsch-derived distillate components with conventional petroleum derived distillate components susceptible to the formation of deposits as shown by a decline in their JFTOT breakpoint.

The highly paraffinic distillate component used in the present invention will have a branching index within the general range of from about 0.5 and about 3, usually from about 0.5 to about 2. Such materials are most readily prepared by refining the products from a low temperature Fisher Tropsch process. The direct products of the low temperature Fischer Tropsch products usually will be further refined which will generally include partial isomerization and hydrocracking for the heavier fractions. The low temperature Fischer Tropsch process which is generally carried out below 250° C. usually will produce high molecular weight products with low to moderate branching. Surprisingly, highly paraffinic distillate products having little or no branching, i.e. products with a branching index below about 0.5, have not been found to display the antagonistic properties relative to the petroleum-derived distillate component as has been observed with the low to moderately branched material described herein. The phenomenon to which the present invention is concerned appears to be limited to jet fuel blends having a branching index within the stated range.

The high temperature Fischer Tropsch process, which is generally carried out at temperatures above 250° C., will produce lower molecular weight olefinic products generally within the $C_3$ to $C_8$ range. The olefinic products from the high temperature Fischer Tropsch process usually undergo oligomerization and hydrogenation steps which produce a highly branched iso-paraffinic product having a branching index of 4 or greater. Researchers working with blends of high temperature Fischer Tropsch products have not described problems associated with blends of the Fischer Tropsch and petroleum-derived components. The thermal stability, or JFTOT, breakpoint for blends of high temperature Fischer Tropsch derived jet with conventional petroleum-derived is presented in the literature as in excess of 300° C. Therefore the thermal stability, or JFTOT, breakpoint for such semi-synthetic blends is significantly above the specification requirement of 260° C. See "Qualification of SASOL Semi-synthetic Jet A-1 as Commercial Jet Fuel", Moses, Stavinoha, and Roets, South West Research Institute Publication SwRI-8531, November 1997.

The branching index referred to in this disclosure is an index which describes the average branching present in the paraffins present in the highly paraffinic distillate component. The method for calculating the branching index uses the methyl resonances in the carbon spectrum and employs a determination or an estimation of the number of carbons per molecule. The number of carbon atoms per molecule can be determined from the molecular weight by use of a gas chromatograph analysis, by a distillation, or by other suitable methods known to the art. To calculate the branching index for the jet products described in this disclosure, first, calculate area counts per carbon by dividing the total carbon area by the number of carbons per molecule. Call this A.

2-branches=half the area of methyls at 22.5 ppm/A 3-branches=area of 19.1 ppm or 11.4 ppm not both/A 4-branches=area of double peaks near 14.0 ppm/A 4+branches=area of 19.6 ppm/A minus the 4-branches internal ethyl branches=area of 10.8 ppm/A Total branches per molecule=sum of areas above.

In carrying out the analysis on the products described herein, the NMR spectra quantitative conditions were as follows: 45 degree pulse every 10.8 seconds, decoupler gated on during 0.8 sec acquisition. Decoupler duty cycle= 7.4% is low enough to keep unequal Overhauser effects from making a difference in resonance intensity. A test of these conditions verified that waiting longer does not make a difference nor does waiting a shorter time. These conditions are a good compromise between time and resolution.

Specifically with regard to jet products prepared from the low temperature Fischer Tropsch process the branching index was calculated for samples using the above method. Based upon the gas chromatographic analysis for the samples, the molecular weight was found to be 187.93 and the average carbon number was 13.28.

The NMR values were found to be:

2-branches=area of methyl at 22.5 ppm/A=0.32

3-branches=area of 19.1 ppm or 11.4 ppm not both/A= 0.30

4-branches=area of double peaks near 14.0 ppm/A=0.39

4+branches=area of 19.6 ppm/A minus the 4-branches= 0.19 internal ethyl branches=area of 10.8 ppm/A=0.22

Total=1.41 (branching index)

The distillate fuel blend will also contain a petroleum-derived fuel blend component. It should be understood that in preparing the distillate fuel blends of the present invention, it is usually desirable to blend the different components in various proportions to meet certain predefined specifications. In the case of jet, these specifications include not only those for stability but also those specifications directed to the burning characteristics of the fuel. From an economic perspective, it is desirable to utilize to the fullest extent possible as much of the refinery streams as possible. Therefore, salable jet fuel available on the commercial market is a mixture of various components having different properties which are blended to meet the appropriate requirements for the fuel. Some petroleum-derived distillates may not be suitable for use as transportation fuels without either being further refined or blended with other components. A particular advantage of the process of the present invention is that it is possible to use a petroleum-derived feed stream which does not meet all of the specification requirements as a blend stock for blending with a highly paraffinic distillate component to produce a salable jet fuel. This represents a significant economic advantage.

The petroleum-derived distillate component also may be referred to as a non-virgin distillate in order to distinguished it from a virgin distillate, i.e., a distillate which is recovered from petroleum crude by distillation without any significant change in the molecular structure. The petroleum-derived distillate component used in preparing the blends of the present invention is recovered from the refining of petroleum-derived feedstocks, such as, by hydrocracking, hydrotreating, fluidized bed catalytic cracking (FCC and the related TCC process), coking, pyrolysis, MEROX® process, MINALK® process, and the like. Accordingly, the petroleum-derived distillate component has been altered during processing. The non-virgin petroleum-derived distillates may be recovered from hydrotreating, hydrocracking, hydrofinishing, and other related hydroprocessing operations. MEROX® and MINALK® process treated distillates are examples of a petroleum-derived distillate fuel blend component which may be used in preparing the fuel compositions which are the subject of the present invention. The MEROX® process and MINALK® process are processes licensed by UOP for removing mercaptans and hydrogen sulfide from petroleum products.

The formation of deposits appears to be related to three factors. The factors are the concentration of species that are readily oxidizable, the ability of the blend to keep oxidized products dissolved, and the conditions of the oxidation, such as, temperature, time, moisture, and the presence of oxidation promoters or inhibitors. It has been found that by carefully controlling the properties of the petroleum-derived distillate and blending procedure as determined by certain very specific conditions as exemplified by ASTM D3241, it is possible to significantly reduce the formation of deposits.

One skilled in the art will recognize that the distillate fuel blend of the present invention may include more than just two components. Various distillate blends containing hydrocarbons obtained from petroleum, Fischer Tropsch processes, hydrocracking of paraffins, the oligomerization and hydrogenation of olefins, etc. may be used to prepare the distillate fuel blend of the present invention. In addition, the distillate fuel blend may contain various additives to improve certain properties of the composition. For example, the distillate fuel composition may contain one or more of additional additives, which include, but are not necessarily limited to, anti-oxidants, dispersants, and the like.

Anti-oxidants reduce the tendency of fuels to deteriorate by preventing oxidation. A good review of the general field is in Gasoline and Diesel Fuel Additives, Critical Reports on Applied Chemistry, Vol. 25, John Wiley and Sons Publisher, Edited by K. Owen. The particular relevant pages are on 4 to 11. Examples of anti-oxidants useful in the present invention include, but are not limited to, phenol type (phenolic) oxidation inhibitors, such as 4,4'-methylene-bis (2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-I-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-α-naphthylamine. Mixtures of compounds may also be used. Antioxidants are added at below 500 ppm, typically below 200 ppm, and most typically from 5 to 100 ppm . The specifications for salable jet fuel limit the antioxidants to 24 mg/l maximum.

As noted above, the formation of peroxides in distillate fuel blends may be controlled by the addition of 1 ppm or more of total sulfur. See WO 00/11116 and WO 00/11117 which describe the use of small amounts of sulfur to stabilize blends containing Fischer Tropsch distillates. Normally the petroleum-derived distillate component will contain sufficient sulfur to meet the minimum sulfur requirements necessary to stabilize the final blend. However, in those instances in which the petroleum-derived distillate component contains insufficient sulfur to stabilize the blend, as for example, in those instances in which the petroleum-derived distillate component has been hydrotreated, the addition of sulfur is an option and may be desirable.

Dispersants are additives that keep oxidized products is suspension in the fuel and thus prevent formation of deposits. A good review of the general field is in Gasoline and Diesel Fuel Additives, Critical Reports on Applied Chemistry, Vol. 25, John Wiley and Sons Publisher, Edited by K. Owen. The particular relevant pages are on 23 to 27. Typically for fuel use, detergents can be categorized as amines. The general types of amines are conventional amines such as an amino amide, and polymeric amines such as polybutene succinimide, polybutene amine, and polyether amines. Some examples of specific detergents and dispersants are described in the following patents and references therein: U.S. Pat. Nos. 6,114,542, 6,033,446, 5,993,497, 5,954,843, 5,916,825, 5,865,801, 5,853,436, 5,851,242, 5,848,048, and 5,830,244. Specific detergents and dispersants are also described in:

Derivatives of polyalkenylthiophosphonic acid such as the

Pentaerythritol ester of polyisobutenylthio-phosphonic acid: U.S. Pat. No. 5,621,154

Polybutene succinimides: U.S. Pat. No. 3,219,666

Polybutene amines U.S. Pat. No. 3,438,757

Polyether amines U.S. Pat. No. 4,160,648

Amine dispersants are typically added at below 500 ppm, typically below 200 ppm, and most typically from 20 to 100 ppm as measured as a concentration in the fuel.

Distillate fuel blends of the present invention may be used as a blending component of salable jet fuel intended for use in a turbine, such as a jet engine. The distillate fuel blend of the present invention may also be used as a salable jet fuel without further blending if it meets the appropriate specifications for that application.

Distillate fuel blend compositions of the present invention are prepared by a process which includes the step of modifying the blending of the various components to achieve a pre-selected stability value. As noted above the minimum acceptable JFTOT breakpoint for a fuel blend of the present invention is 260° C. as determined by ASTM D3241. Preferably the breakpoint of the distillate fuel blend will exceed this target. It is preferred that the petroleum-derived distillate fuel component have a JFTOT breakpoint of at least 275° C., preferably at least 290° C., and most preferably at least 300° C. As already noted above, certain additives have been shown to affect the thermal stability of the fuel blend as measured by the preferred test method, i.e. ASTM D3241. In addition, hydrotreating of the petroleum-derived distillate fuel component has been found to significantly improve the thermal stability of the blend. Aside from these preferred methods, several other means may be used to modify the blending step in order to achieve the target stability value. The blending ratio of the highly paraffinic distillate fuel component and the petroleum derived distillate fuel component may be adjusted; the boiling range of the highly paraffinic distillate fuel component may be adjusted; or the degree of isomerization of the highly paraffinic distillate fuel component may be adjusted. One skilled in the art will recognize that each of the foregoing methods for modifying the blend of the various components are not mutually exclusive. Depending on circumstances, it may be advantageous to utilize any combination of the methods described above in preparing the distillate fuel blend.

The stability of the fuel blend is dependent upon the ratio of the highly paraffinic distillate fuel component and the petroleum-derived fuel component. Unfortunately, the relationship between stability and the ratio of the different components is complex. It is dependent not only on the ratio between the two or more components, but also on the amount of paraffins present, the presence of additives, previous hydroprocessing of the conventional component, and the JFTOT breakpoint of the conventional component. Therefore in order to achieve a acceptable degree of stability, it is important to modify the properties of the petroleum-derived distillate or the blending ratios according to the breakpoint values obtained from samples taken during the blending process. Some testing is essential to achieve the desired degree of stability, however according to the present invention this should involve only routine testing which is well within the ability of one skilled in the art. In general, when carrying out the process of the present invention, it is preferred that the paraffin content of at least one of the highly paraffinic distillate fuel components present be greater than 80 percent by weight, with 90 percent being even more preferred.

The stability of the fuel blend may also be adjusted by changing the boiling range of the highly paraffinic distillate fuel component or by controlling the extent of isomerization of the highly paraffinic distillate fuel component.

As already noted, he stability of the distillate fuel blend may also be improved by hydrotreating the petroleum-derived distillate fuel component. This may be accomplished by adding another step prior to the initial blending step. The stability of the distillate blend may also be improved by subjecting the petroleum-derived distillate to a solvent extraction or adsorption step. These processes are all well known to those skilled in art and should not require any detailed explanation. However, it should also be understood that these methods are not mutually exclusive and may be used in various combinations. It is not well understood why the further processing of the petroleum-derived distillate improves the stability of the final blend. It has been speculated that it relates to a reduction in the amount of aromatics present in the petroleum-derived distillate, however the results of studies conducted to confirm this relationship have been inconclusive. Therefore, the results achieved by use of the process of the present invention are especially surprising.

The following examples are intended to illustrate specific embodiments of the present invention and to clarify the invention, but the examples should not be interpreted as limitations upon the broad scope of the invention.

EXAMPLES

Example 1

The preparation of a moderately branched Fischer Tropsch distillate fuel component was demonstrated using a commercial sample of Fischer Tropsch C-80 wax obtained from Moore and Munger Co. The material had an initial boiling point as determined by ASTM D-2887 of 790° F. and a boiling point at 5 Wt % of 856° F. It was hydrocracked in a single stage pilot plant at 669° F., 1.0 LHSV, 1000 psig, 10,000 SCF/Bb1 Hydrogen at about 90% conversion in a once-through operation (without recycle). A commercial sulfided hydrocracking catalyst was used. A 260–600° F. jet product with the following properties was recovered by distillation:

| | |
|---|---|
| Density at 15° C., g/ml | 0.7626 |
| Sulfur, ppm | 0 |
| Viscosity at −20° C., cSt | 6.382 |
| Freeze Point, ° C. | −47.7 |
| Cloud Point, ° C. | −51. |
| Flash Point, ° C. | 54. |
| Smoke Point, mm | >45 |

Hydrocarbon types, Wt % by Mass Spec (ASTM D-2789) were as follows:

| | |
|---|---|
| Paraffins | 93.1 |
| Mono-cycloparaffins | 5.2 |
| Di-cycloparaffins | 1.5 |
| Alkylbenzenes | 0.5 |
| Benzonaphthalenes | <0.5 |
| Naphthalenes | <0.5 |

N-paraffin Analysis by GC are given in Table 1, below.

TABLE 1

| CARBON NUMBER | DISTRIBUTION (Wt. Percent) | NORMAL PARAFFIN | NON N-PARAFFIN |
|---|---|---|---|
| 6 | 0.00 | 0.00 | 0.00 |
| 7 | 0.00 | 0.00 | 0.00 |
| 8 | 0.12 | 0.10 | 0.02 |
| 9 | 8.75 | 1.83 | 6.92 |
| 10 | 10.95 | 1.56 | 9.39 |
| 11 | 11.25 | 1.22 | 10.03 |
| 12 | 11.24 | 1.19 | 10.05 |
| 13 | 11.26 | 0.68 | 10.58 |
| 14 | 10.66 | 0.77 | 9.90 |
| 15 | 10.21 | 0.58 | 9.62 |
| 16 | 9.70 | 0.41 | 9.29 |
| 17 | 9.37 | 0.30 | 9.07 |
| 18 | 6.36 | 0.03 | 6.33 |
| 19 | 0.12 | 0.00 | 0.12 |

TABLE 1-continued

| CARBON NUMBER | DISTRIBUTION (Wt. Percent) | NORMAL PARAFFIN | NON N-PARAFFIN |
|---|---|---|---|
| 20 | 0.02 | 0.00 | 0.02 |
| 21 | 0.00 | 0.00 | 0.00 |
| 22–52 | 0.00 | 0.00 | 0.00 |
| TOTAL | 100.00 | 8.67 | 91.33 |
| Average Carbon Number: | | 13.28 | |
| Average Molecular Weight: | | 187.93 | |

Simulated Distillation, ° F. by Wt %, ASTM D-2887 was as follows:

| | |
|---|---|
| 0.5% | 267 |
| 5% | 287 |
| 10% | 310 |
| 20% | 342 |
| 30% | 378 |
| 40% | 405 |
| 50% | 439 |
| 60% | 472 |
| 70% | 504 |
| 80% | 535 |
| 90% | 564 |
| 95% | 579 |
| 99% | 595 |
| 99.5% | 598 |

The fuel was analyzed for peroxides and trace metals. All metals were below the limit of detection indicating that these potential impurities did not interfere with the experimental results. The peroxides were 1.9 ppm, which is less than the 5 ppm limit recommended in WO 00/11116. Thus this small amount of peroxide is not believed to contribute to stability problems. The metal analysis was as follows:

| | |
|---|---|
| Cu | <5 ppb |
| Fe | <50 ppb |
| Pb | <125 ppb |
| Zn | <25 ppb |

The branching index calculated as discussed above was 1.41.

Example 2

Commercial jet fuels were obtained with properties shown below in Table 2. Two from the same source were prepared by MEROX® process treating, one by the related process called the MINALK® process, and the other by hydrotreating. MEROX® process and MINALK® process treating converts mercaptan sulfur species into disulfides which reduces the corrosive nature of the sulfur but leaves aromatics, nitrogen and other species essentially intact. Hydrotreating in comparison removes some of the sulfur, nitrogen and unsaturates, and also a portion of the aromatics.

TABLE 2

| | MEROX ® Process Treated Jet Fuel (J-768) | Hydrotreated Jet Fuel (J-769) | MINALK ® Process Jet Blend Component (J-802) | MEROX ® Process Jet - Sample 2 (J-843) |
|---|---|---|---|---|
| Density at 15° C., g/ml | 0.8050 | 0.8102 | 0.8266 | 0.7823 |
| Sulfur, ppm | 1340 | 477 | 1770 | 187 |
| Viscosity at −20° C., cSt | 4.409 | 5.142 | 4.406 | 3.448 |
| Freeze Point, ° C. | −51.1 | −44 | −49.1 | −48 |
| Flash Point, ° C. | 52.8 | 53.9 | 53.9 | 42.2 |
| Smoke Point, mm | 19 | 19 | 17 | 20 |
| Nitrogen, ng/ul | <0.20 | 8.28 | 27.18 | |
| Total olefins by SFC, % m | 4.9 | 4.7 | 7.9 | 3.5 |
| Olefins (D1319) vol % | 0.5 | 0.7 | 0.9 | 0 |
| Saturates (D1319) vol % | 83.8 | 83.0 | 64.3 | 83.5 |
| Aromatics (D1319) vol % | 15.7 | 16.3 | 34.8 | 16.5 |

50-50 blends of the Fischer Tropsch distillate components with 2 conventional distillate fuel components were prepared and the thermal stability (JFTOT breakpoints) was determined on the original and the blends. The breakpoints of the blends were lower than the breakpoints of the original components. The starting components had relatively high breakpoints, so even though the blends were less stable, for this case, they were still above the specification minimum. The results are shown in Table 3.

TABLE 3

| Sample | JFTOT Breakpoint, ° C. | Change in JFTOT B Breakpoint upon blending, ° C. |
|---|---|---|
| Fischer Tropsch Jet Fuel, Experiment 1 (J-792) | >310 | — |
| MEROX ® Treated Jet Fuel (J-768) | 305 | — |
| Hydrotreated Jet Fuel (J-769) | 290 | — |
| 50-50 Bend of FT Jet fuel with MEROX ® Treated Jet Fuel* | 275 or 280 | −25 or −30 |
| 50-50 Bend of FT Jet fuel with Hydrotreated Jet Fuel | 275 | −15 |

*The sample was insufficient to complete the breakpoint testing.

The precision of breakpoint determination has not been determined. Most experts feel that a difference of 5° C., the smallest interval usually tested, is not significant. But a difference of 10° C. or more is considered significant. Thus these results represent a significant decline in the stability of the blend in comparison to the components. However it also shows that the decline in blending a hydrotreated jet fuel with a Fischer Tropsch jet fuel is less than the decline in blending a MEROX® process treated jet fuel.

As can be seen from this data, forming 50-50 blends of Fischer Tropsch distillate fuel components with a conventional distillate fuel component forms a blend that has a JFTOT breakpoint 15 to 30° C. below the value of the conventional distillate fuel component. Thus for 50—50 blends, the conventional distillate fuel component would need to have a JFTOT breakpoint in excess of 275° C. in order for the blend to likely be in excess of 260° C. Preferably the conventional distillate fuel component should have a JFTOT breakpoint in excess of 290° C., and most preferably in excess of 300° C.

Example 3

A series of experiments were conducted with varying levels of Fischer Tropsch Jet Fuel with commercial jet fuels. Additional samples of conventional jet fuels or jet fuel blend components prepared by the MEROX® process and related MINALK® process were obtained and evaluated as neat components and in blends with the Fischer Tropsch jet fuel. The results of the JFTOT tests are shown in Table 4

TABLE 4

| | 100% Conventional Jet | 98% Jet 2% FT blend | 95% Jet 5% FT blend | 90% Jet 10% FT blend | 75% Jet 25% FT blend |
|---|---|---|---|---|---|
| MINALK ® Jet (J-802) | | | | | |
| Breakpoint, ° C. | 270 | | | 250 | 245 |
| Change, ° C. | | | | −20 | −25 |
| MEROX ® Jet - Sample 2 (J-843) | | | | | |
| Breakpoint, ° C. | 285 | 275 | 265 | 260 | |
| Change, ° C. | | −10 | −20 | −25 | |

These results show that blends of Fischer Tropsch jet fuel can result in a significant decline in the JFTOT breakpoint. The second MEROX® sample showed a decline in JFTOT breakpoint of 10° C. with only 2% Fischer Tropsch jet fuel, and 25° C. decline with 10% Fischer Tropsch Jet Fuel. These results show that incorporation of very small amounts of a highly paraffinic jet fuel with a conventional jet fuel prepared by the MEROX® process or related MINALK® process can generate a product having a significant decline in stability as measured by the JFTOT breakpoint. Even though the petroleum-derived distillate component has an acceptable rating, in some cases, the decline in thermal stability can be so great that the blend will fail the 260° C. JFTOT breakpoint specification.

Example 4

A commercial diesel fuel stability improver additive (EC5111A) from Nalco was obtained and its effect on breakpoint was demonstrated on partial synthetic blends. This additive is a multi-purpose additive and contains a dispersant and antioxidant. The results are shown in Table 5.

TABLE 5

| Blend | Change in JFTOT Breakpoint from neat MEROX ® Process Jet Fuel, ° C. |
|---|---|
| 10% FT + 90% MEROX ® Jet | −25 |
| 10% FT + 90% MEROX ® Jet + 50 ppm Additive | −15 |

It will be seen from the results that use of this additive at 50 ppm reduces but does not eliminate the decline in the JFTOT breakpoint.

Example 5

The effect of isomerization on thermal stability was demonstrated. Pure n-C12 was isomerized over a Pt/SSZ-32 catalyst followed by a Pd/Si—Al aromatics saturation catalyst. Conditions for the isomerization were:

2300 PSIG total pressure

4000 SCFB once through H2

1.5 LHSV

Two isomerization levels (high and low) were targeted. A stripper operating at 300° F. was used to produce a stripper bottoms isomerized product and a stripper overhead that consisted mostly of cracked products. The overhead and stripper bottoms products were analyzed by GC to obtain the composition of the liquid product and the conversion. Results for isomerization of n-C12 are shown in Table 6.

TABLE 6

| | Low n-C12 Conversion, wt % | High n-C12 Conversion, wt % |
|---|---|---|
| n-C12 Conversion, wt % | 40.3 | 59.0 |
| n-C12 content in stripped product, wt % | 64.9 | 46.6 |
| C12 Isoparaffins in content in stripped product, wt % | 34.0 | 51.6 |

The low and high conversion isomerized product were blended with a MEROX® process Jet fuel to give the results shown in Table 7. While not directly measured, the branching index of these two isomerized dodecane samples can be estimated to be approximately 0.5 because the branching index of the n-C12 in the sample is zero, while the branching index of the C12 isoparaffins in the sample will be between 1.0 and 2.0.

TABLE 7

| Blend | Change in JFTOT Breakpoint from neat MEROX ® Jet Fuel, ° C. |
|---|---|
| 10% Dodecane + 90% MEROX ® Jet | 5 |
| 10% Highly Isomerized Dodecane + 90% MEROX ® Jet | −15 |
| 10% Moderately Isomerized Dodecane + 90% MEROX ® Jet | −15 |

While the n-C12 (zero branching index) resulted in no significant change in stability, both of the blends containing isomerized products did result in a significant decline. Similar tests with n-hexane and C-16 (both with zero branching index) showed no significant decline in JFTOT breakpoint. Thus low to moderately branched iso-paraffins appear to be associated with the decline in thermal-oxidation stability, and it is desirable to limit the extent of isomerization as much as possible. However, the heavy normal paraffin content of the fuel must be limited (by distillation or isomerization) in order to meet the Freeze Point requirements.

What is claimed is:

1. A distillate fuel blend useful as a fuel or as a blending component of a fuel suitable for use in a turbine engine, said distillate fuel blend comprising:

(a) at least one highly paraffinic distillate fuel component having a paraffin content of not less than 70 percent by weight and a branching index within the range of from about 0.5 to about 3; and (b) at least one non-virgin petroleum-derived distillate fuel component, wherein the components have antagonistic properties with respect to one another and further wherein the distillate fuel blend has an ASTM D3241 breakpoint equal to or greater than 260° C.

2. The distillate fuel blend of claim 1 wherein the paraffin content of the highly paraffinic distillate fuel component is not less than 80 percent by weight.

3. The distillate fuel blend of claim 2 wherein the paraffin content of the highly paraffinic distillate fuel component is not less than 90 percent by weight.

4. The distillate fuel blend of claim 1 wherein the highly paraffinic distillate fuel component is at least partially derived from the oligomerization and hydrogenation of olefins.

5. The distillate fuel blend of claim 1 wherein the highly paraffinic distillate fuel component is at least partially derived from the hydrocracking of paraffins.

6. The distillate fuel blend of claim 1 wherein the highly paraffinic distillate fuel component is at least partially derived from the low temperature Fischer Tropsch process.

7. The distillate fuel blend of claim 1 further including a peroxide inhibitor.

8. The distillate fuel blend of claim 7 containing 1 ppm or greater of sulfur.

9. The distillate fuel blend of claim 1 wherein the distillate fuel blend has an ASTM D3241 breakpoint of greater than 270° C.

10. The distillate fuel blend of claim 1 wherein the distillate fuel blend has an ASTM D3241 breakpoint of greater than 280° C.

11. The distillate fuel blend of claim 1 wherein the at least one non-virgin petroleum derived distillate fuel component has an ASTM D3241 breakpoint of 275° C. or higher.

12. The distillate fuel blend of claim 1 wherein the at least one non-virgin petroleum derived distillate fuel component has an ASTM D3241 breakpoint of 290° C. or higher.

13. The distillate fuel blend of claim 1 wherein the at least one non-virgin petroleum derived distillate fuel component has an ASTM D3241 breakpoint of 300° C. or higher.

14. A distillate jet fuel blend useful as a fuel or as a blending component of a fuel suitable for use in a turbine engine, said distillate jet fuel blend comprising:

(a) from about 2 to about 25 weight percent based upon the total distillate jet fuel blend of at least one highly paraffinic Fischer Tropsch distillate fuel component having a paraffin content of not less than 70 percent by weight and a branching index within the range of from about 0.5 to about 3; and (b) from about 75 to about 98 weight percent based upon the total distillate jet fuel blend of at least one non-virgin petroleum-derived distillate fuel component, wherein the components have antagonistic properties with respect to one another and further wherein the distillate jet fuel blend has an ASTM D3241 breakpoint equal to or greater than 260° C.

15. The distillate jet fuel blend of claim 14, wherein the highly paraffinic Fischer Tropsch distillate fuel component is at least partially derived from a low temperature Fischer Tropsch process.

16. The distillate jet fuel blend of claim 14, wherein the non-virgin petroleum-derived distillate fuel component is a hydrotreated petroleum-derived distillate fuel.

17. The distillate jet fuel blend of claim 14, further including a peroxide inhibitor.

18. The distillate jet fuel blend of claim 17, containing 1 ppm or greater of sulfur.

19. The distillate jet fuel blend of claim 17, wherein the distillate jet fuel blend has an ASTM D3241 breakpoint of greater than 270° C.

20. The distillate jet fuel blend of claim 14, wherein the distillate jet fuel blend has an ASTM D3241 breakpoint of greater than 280° C.

21. The distillate jet fuel blend of claim 14, wherein the at least one non-virgin petroleum derived distillate fuel component has an ASTM D3241 breakpoint of 275° C. or higher.

22. The distillate jet fuel blend of claim 14, wherein the at least one non-virgin petroleum derived distillate fuel component has an ASTM D3241 breakpoint of 290° C. or higher.

23. The distillate jet fuel blend of claim 14, wherein the at least one non-virgin petroleum derived distillate fuel component has an ASTM D3241 breakpoint of 300° C. or higher.

* * * * *

UNITED STATES PATENT AND TRADEMARK OFFICE

CERTIFICATE OF CORRECTION

PATENT NO. : 6,846,402 B2
DATED : January 25, 2005
INVENTOR(S) : Gregory Hemighaus et al.

It is certified that error appears in the above-identified patent and that said Letters Patent is hereby corrected as shown below:

Column 15,
Line 14, delete "claim 17" and insert -- claim 14 -- in place thereof.

Signed and Sealed this

Second Day of August, 2005

JON W. DUDAS
*Director of the United States Patent and Trademark Office*